US010687673B2

(12) United States Patent
Abrams et al.

(10) Patent No.: US 10,687,673 B2
(45) Date of Patent: Jun. 23, 2020

(54) DOOR HEADER

(71) Applicant: 310 Tempering, Jeffersontown, KY (US)

(72) Inventors: Greg Lee Abrams, Louisville, KY (US); Christopher Andrew Murphy, Louisville, KY (US)

(73) Assignee: 310 Tempering, Jeffersontown, KY (US)

( * ) Notice: Subject to any disclaimer, the term of this patent is extended or adjusted under 35 U.S.C. 154(b) by 103 days.

(21) Appl. No.: 16/025,027

(22) Filed: Jul. 2, 2018

(65) Prior Publication Data

US 2019/0038084 A1 Feb. 7, 2019

Related U.S. Application Data

(60) Provisional application No. 62/619,961, filed on Jan. 22, 2018.

(51) Int. Cl.

| | |
|---|---|
| ***A47K 3/34*** | (2006.01) |
| ***E05D 15/06*** | (2006.01) |
| ***E05D 5/02*** | (2006.01) |
| *E06B 3/46* | (2006.01) |

(52) U.S. Cl.

CPC ..... *A47K 3/34* (2013.01); *E05D 5/0246* (2013.01); *E05D 15/063* (2013.01); *E05D 15/0652* (2013.01); *E05Y 2201/224* (2013.01); *E05Y 2201/684* (2013.01); *E05Y 2600/12* (2013.01); *E05Y 2600/31* (2013.01); *E05Y 2600/312* (2013.01); *E05Y 2600/456* (2013.01); *E05Y 2600/634* (2013.01); *E05Y 2800/672* (2013.01); *E05Y 2900/114* (2013.01); *E06B 3/4681* (2013.01)

(58) Field of Classification Search

CPC ..... E05D 5/0246; E05D 2005/0253; E05D 2005/0261; E05D 2005/0269; E05D 15/063; E05D 15/0652; A47K 3/34

USPC ..... 16/96 L, 94 R

See application file for complete search history.

(56) References Cited

U.S. PATENT DOCUMENTS

| | | | | |
|---|---|---|---|---|
| 6,609,350 | B1 | 8/2003 | Weber | |
| D729,049 | S * | 5/2015 | Andren | D8/373 |
| 10,070,757 | B2 * | 9/2018 | Jacob | A47K 3/34 |
| 2011/0072613 | A1 * | 3/2011 | Hays | E05D 13/1276 16/91 |
| 2015/0020457 | A1 | 1/2015 | Bouthillier | |
| 2017/0196412 | A1 * | 7/2017 | Jacob | A47K 3/34 |

FOREIGN PATENT DOCUMENTS

| | | |
|---|---|---|
| CN | 101324168 | 12/2008 |
| DE | 20 2008 014 323 | 1/2009 |

OTHER PUBLICATIONS

Photograph and drawing of product sold in 2012 as "Illusion Series".

* cited by examiner

*Primary Examiner* — Jeffrey O'Brien

(74) *Attorney, Agent, or Firm* — Theresa Camoriano; Guillermo Camoriano; Duncan Galloway Egan Greenwald PLLC

(57) ABSTRACT

A laminated glass header for supporting a shower door. The header may have a taper at one or both of its ends to provide an automatic full open or full close feature of the door.

10 Claims, 10 Drawing Sheets

DOOR HEADER

This application claims priority from U.S. Provisional Application Ser. 62/619,961 filed Jan. 22, 2018, which is hereby incorporated herein by reference.

BACKGROUND

The present invention relates to a support member/header that spans the opening to a shower or bathtub stall, wherein the door or doors that are used to close off the stall are supported by the header.

The term "shower stall" as used herein refers to any enclosed area such as a shower area or a bathtub stall or any type of room. Shower stalls often are enclosed by two or more sliding doors which hang from, and are supported by, a header which spans the opening to the shower stall. This header typically is a metal header, often an extruded aluminum member, secured at both its ends to walls via brackets. While the shower doors may be made of glass, providing a good view of the attractive tile work in the shower stall, the header, which is made of metal, blocks that view.

SUMMARY

An embodiment of the present invention provides a glass frame member/header which replaces the metal header used in a shower stall. This glass header is more aesthetically appealing and provides an unimpeded view of the shower stall, including any decorative details in the shower area, such as tile work. In one embodiment, at least one end of the glass header includes an auto-closure feature.

DESCRIPTION

Figure 1:
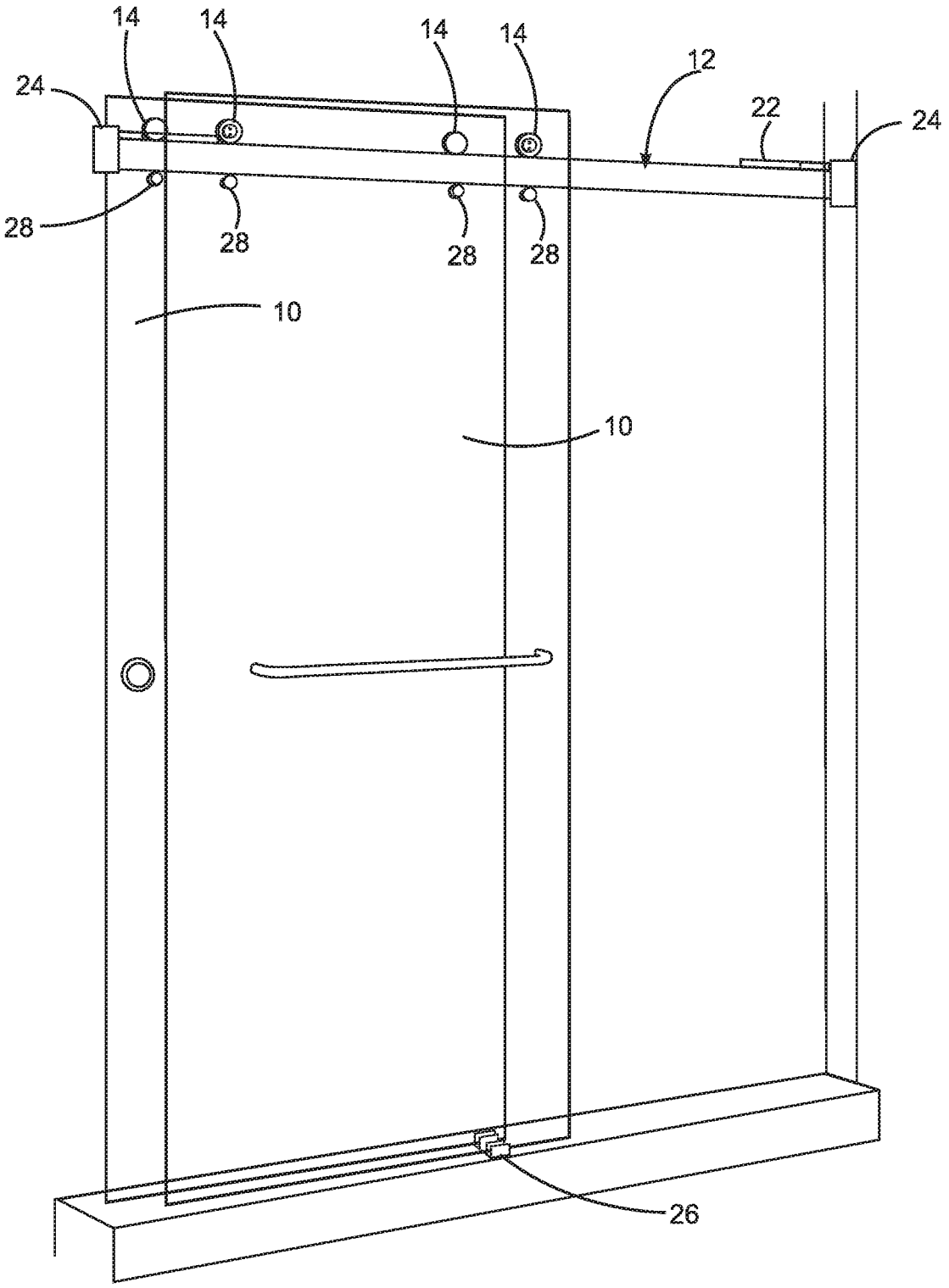
FIG. 1 is a perspective view of two shower doors, with one of the doors in the open position, supported by a header made in accordance with one embodiment of the present invention.

FIGS. 1-8 show a first embodiment of a shower stall with two glass sliding doors 10. Referring to FIG. 1, the shower doors 10 are mounted on a support header 12, which is made of laminated glass pieces that span the width of the opening into the shower stall, as described in more detail later. Left and right brackets 24 secure the ends of the header 12 to the walls of the shower stall. Each door 10 hangs from the header 12 via two upper, flanged rollers 14, each of which has an axle 13 (See FIG. 7A) that extends through an opening in the glass door 10 that is slightly larger than the diameter of the axle 13.

The axle 13 is secured to the flanged roller 14 on one side of the glass door 10 and to an end cap 15 on the other side of the glass door 10. The flanged roller 14 and the end cap 15 are larger than the opening in the glass door through which the axle 13 extends, so, once the axle is extended through the opening, with the flanged roller 14 on one end, and the end cap 15 is secured on the other end, the assembly of axle 13, flanged roller 14 and end cap 15 is secured on the glass door 10.

Figure 7:
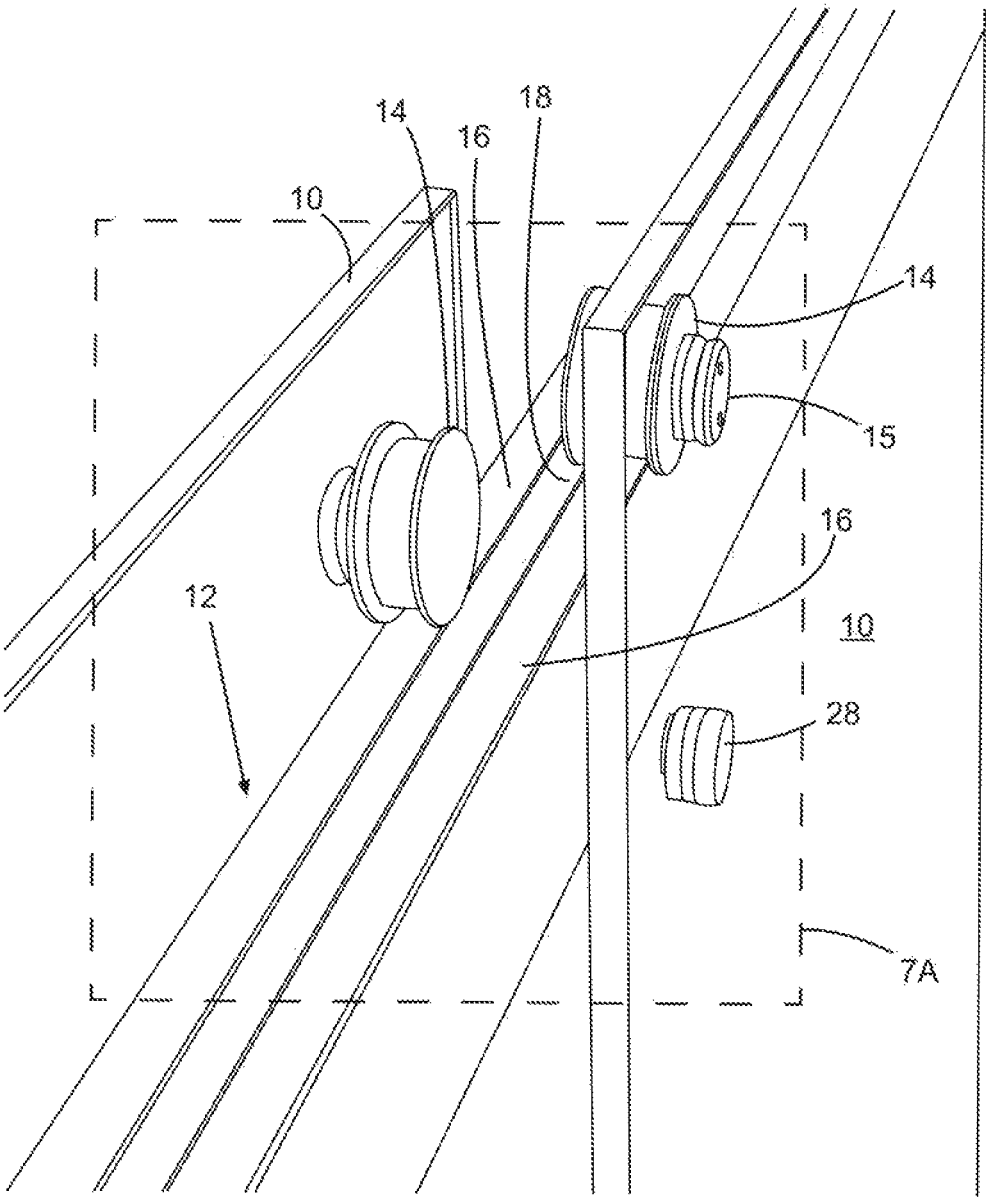
FIG. 7 is a broken-away top perspective view of the header of FIG. 1, showing how both doors ride along the top of the header.
Figure 7A:
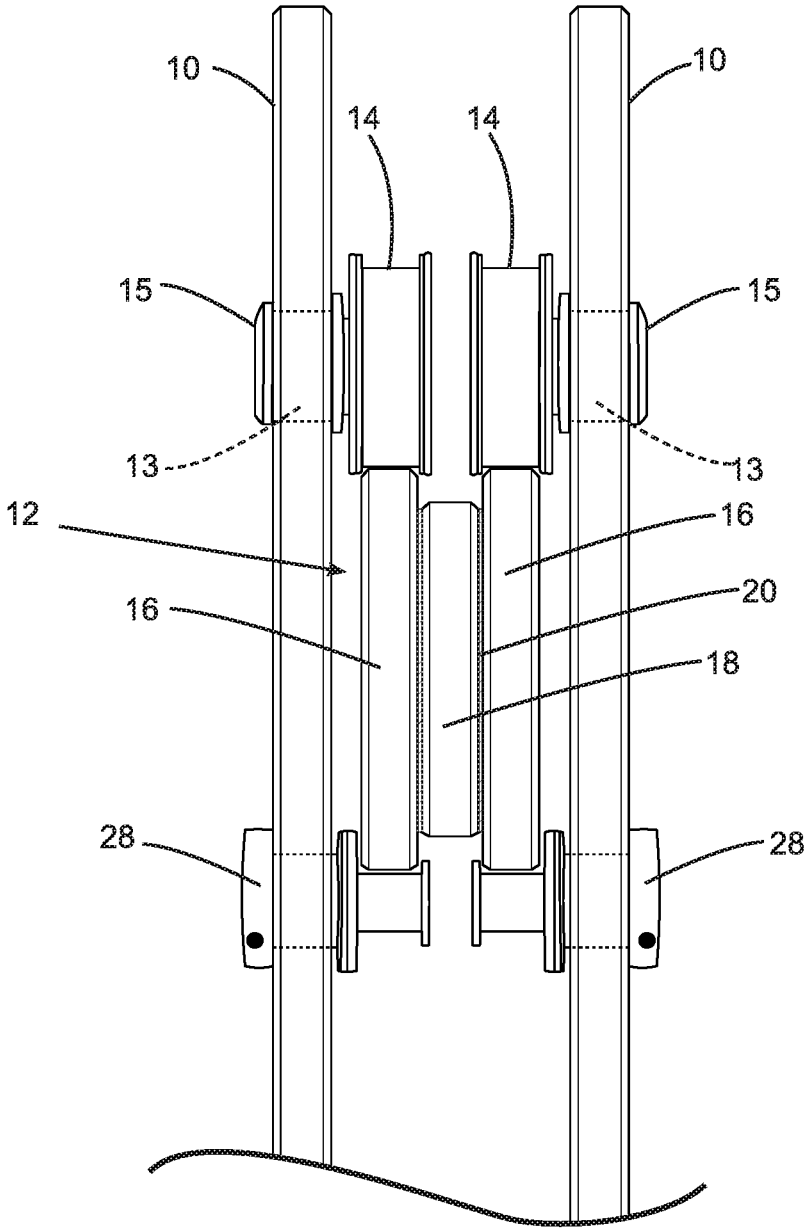
FIG. 7A is an end view of the area in the dotted rectangle 7A of FIG. 7.
Figure 8:
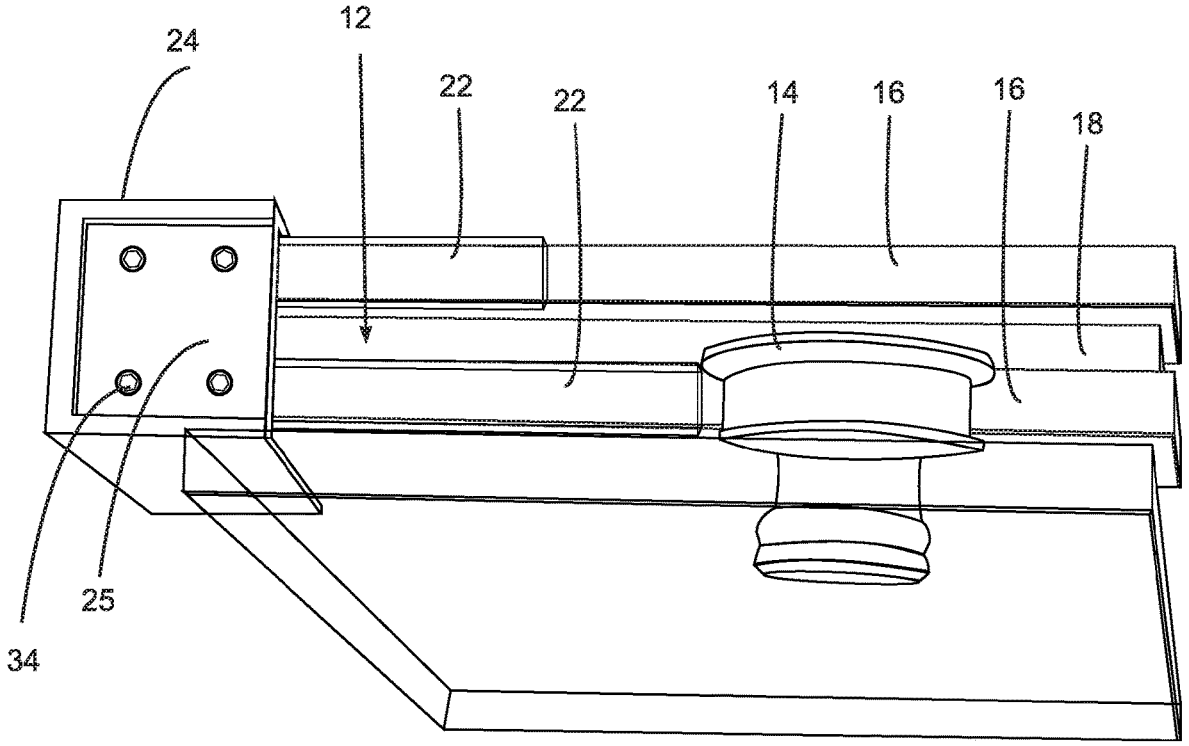
FIG. 8 is a top perspective view of the end of one of the doors as its roller is stopped by a clear stop.

Each upper, flanged roller 14 rides atop the header 12, as shown in FIGS. 1, 7, and 7A. As shown in more detail in FIGS. 7 and 7A, the header 12 includes front and rear glass rails 16 and a recessed glass spacer 18 laminated between the front and rear glass rails 16. The central portion of each roller 14 rides on the top edge of its respective glass rail 16 of the header 12, with the flanges of the roller 14 extending down along the front and rear faces of the respective glass rail 16 of the header 12. The rollers 14 of one glass door 10 ride on one of the front and rear glass rails 16, and the rollers 14 of the other glass door 10 ride on the other of the front and rear glass rails 16.

Figure 2:
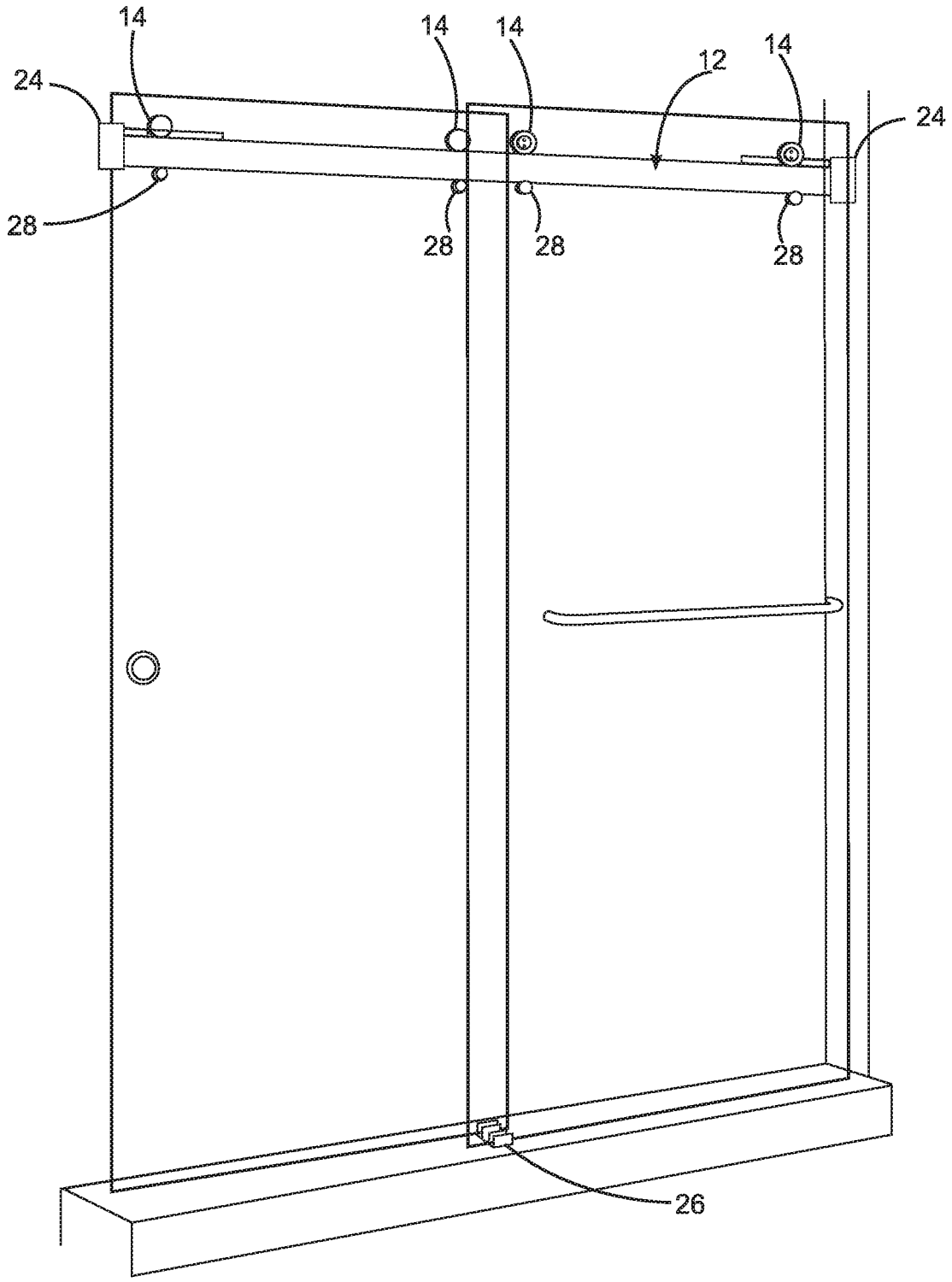
FIG. 2 is a perspective view of a shower stall with the two shower doors of FIG. 1 in the closed position, wherein the header of FIG. 1 provides an unobstructed view of the tile work or other features behind the glass doors and behind the glass header.

As discussed in more detail later, the header 12 is made from parallel pieces of transparent glass that are laminated together to provide structural strength as well as an aesthetically pleasing, open, and clear view of the shower area, as shown in FIG. 2. Lower pins 28 (See FIG. 7A) are secured to the glass doors 10 directly below their respective upper flanged rollers 14 and adjacent to the bottom edge of the respective glass rail 16 to prevent the glass doors 10 from being lifted up, off of the header after they are installed. It should be noted that alternatively, instead of the lower pins 28, lower flanged rollers could be used, with the flanges of each lower flanged roller lying adjacent to the front and rear faces of the bottom of the respective glass rail 16. Whether lower pins 28 or lower flanged rollers (not shown) are used, they extend through a respective opening in the glass door that is slightly larger than the diameter of the pin or roller axle, and they have enlarged ends, larger than the diameter of the respective opening, that secure them to the glass door at the respective opening.

Figure 4:
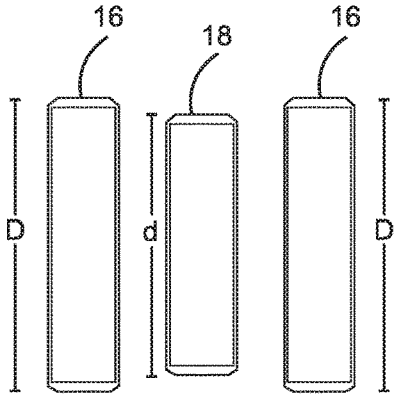
FIG. 4 is a section view of a first step in the production of the header of FIG. 1.
Figure 5:
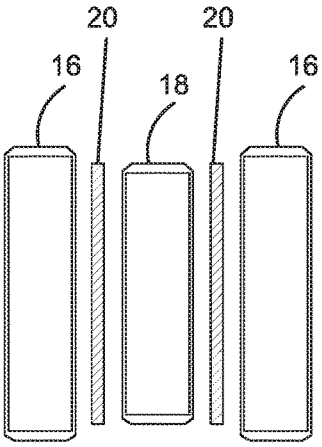
FIG. 5 is a section view of a second step in the production of the header of FIG. 1.
Figure 6:
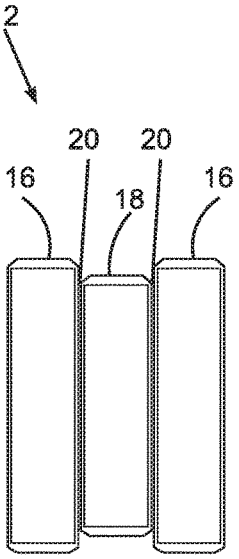
FIG. 6 is a section view of the finished header of FIG. 1.

Referring to FIGS. 4-6, the header 12 is made from two, elongated taller rail pieces 16 and one shorter spacer piece 18, all of which are made of clear (low iron) glass. The rails 16 and spacer 18 are polished, tempered, and laminated together using two structural interlayers 20. The rail pieces 16 are on the outside, with the spacer 18 between them. The structural interlayers 20 provide durability and structural integrity without detracting from the visual clearness of the glass.

In the example shown in FIG. 4, the three pieces of glass 16, 18 are ⅜ inch thick, clear glass. Each of the rail pieces 16 has a height dimension "D" of 3⅛ inch, and the spacer piece 18 has a height dimension "d" of 2¾ inch. The rail pieces 16 and spacer piece 18 are long enough to span the full width of the opening to the shower stall, extending the full distance between the left and right brackets 24.

The rail pieces 16 are parallel to each other and have their top edges at the same height. These rail pieces 16 serve as the front and rear rails on which the upper flanged rollers 14 for the respective front and rear shower doors 10 ride. The top edge of the spacer piece 18 is recessed downwardly from the top edges of the rail pieces 16 a sufficient distance to allow the upper flanged rollers 14 to fully seat over the top edges of the rail pieces 16 without the flanges contacting the spacer piece 18.

The header 12 is made by laminating together the outer glass rail pieces 16 and the inner glass spacer piece 18 using interlayer strips 20 that are cut to a height of 2⅝ inch and that extend the full length of the header 12. As shown in FIG. 5, there are two interlayer strips 20. One interlayer strip 20 lies between the first outer glass rail piece 16 and one face of the inner glass spacer piece 18, and the other interlayer strip 20 lies between the opposite face of the inner glass spacer piece 18 and the second outer glass rail piece 16. As noted above, the top edge of the inner glass spacer piece 18 is recessed below the top edges of the outer glass rail pieces 16 to provide space for the flanges of the upper flanged rollers 14, as best illustrated in FIG. 7A. The bottom edge of the inner glass spacer piece 18 also is recessed relative to the bottom edges of the outer glass rail pieces 16, so the header 12 is symmetrical and can be installed upside down without creating a problem. Also, as mentioned above, lower flanged rollers could be used instead of the lower pins 28, with the lower flanged rollers adjacent to the bottom edges of the rails 16.

So, in this embodiment, the profile of the header 12 has an "H" shape and is symmetrical about a horizontal axis, as shown in FIG. 6.

In order to manufacture the header 12, the assembly of the outer glass rail pieces 16, inner glass spacer piece 18, and interlayer strips 20 is temporarily held together with heat tape to maintain the desired H-shaped profile, and then is placed inside a laminating oven (not shown). After several hours in the oven, the three pieces of glass 16, 18 are connected together by the two pieces of interlayer 20 to form one strong, laminated header 12. In this embodiment, the interlayer strips 20 are made of SentryGlas® Plus (SGP), which is made by DuPont. The result is a laminated glass header that is transparent.

Figure 3A:
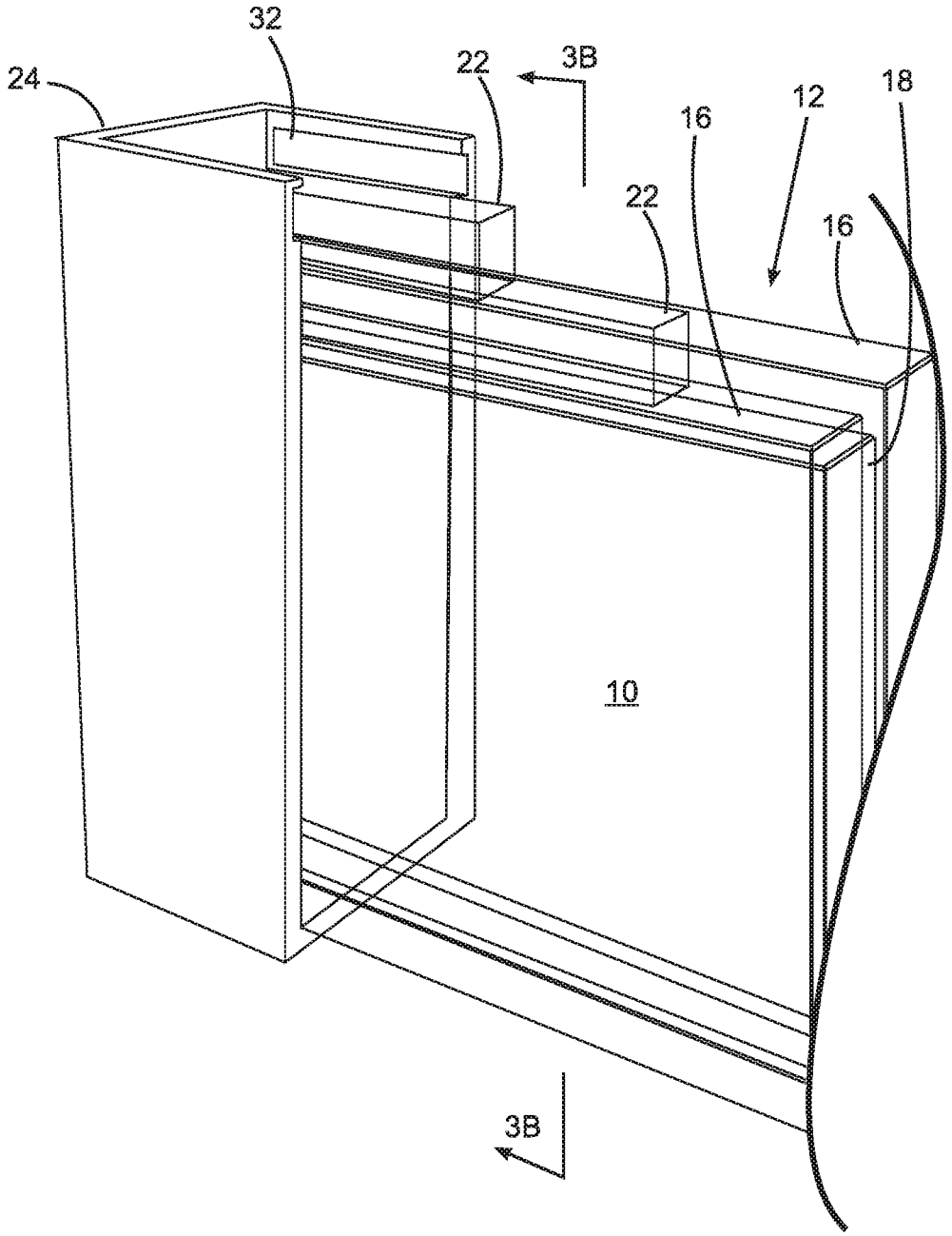
FIG. 3A is a broken-away, perspective view of the left end of the header of FIG. 1, showing the mounting bracket and the shower door stops.
Figure 3B:
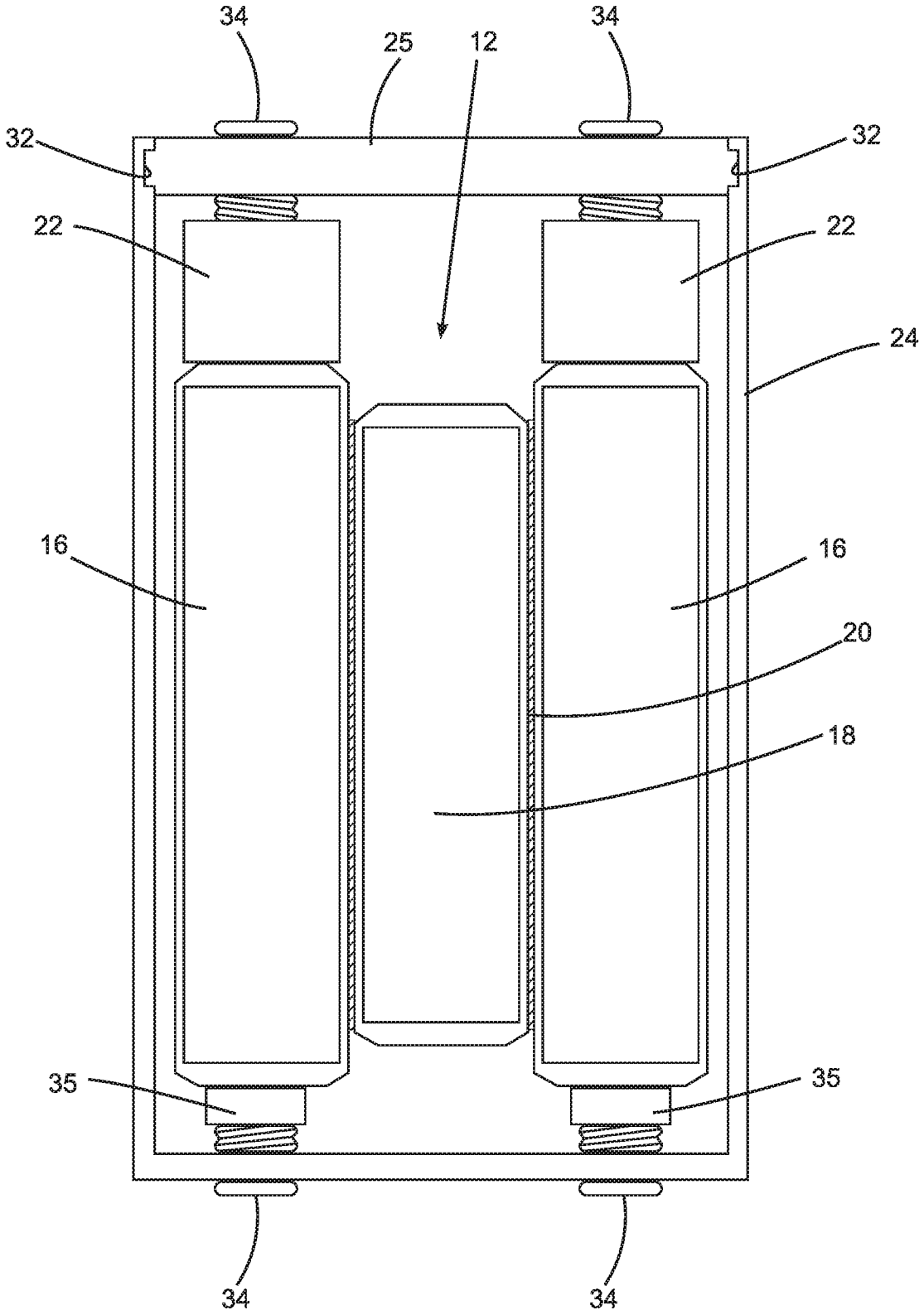
FIG. 3B is a section view along line 3B-3B of FIG. 3A but also including the bracket cap installed on the mounting bracket.
Figure 3C:
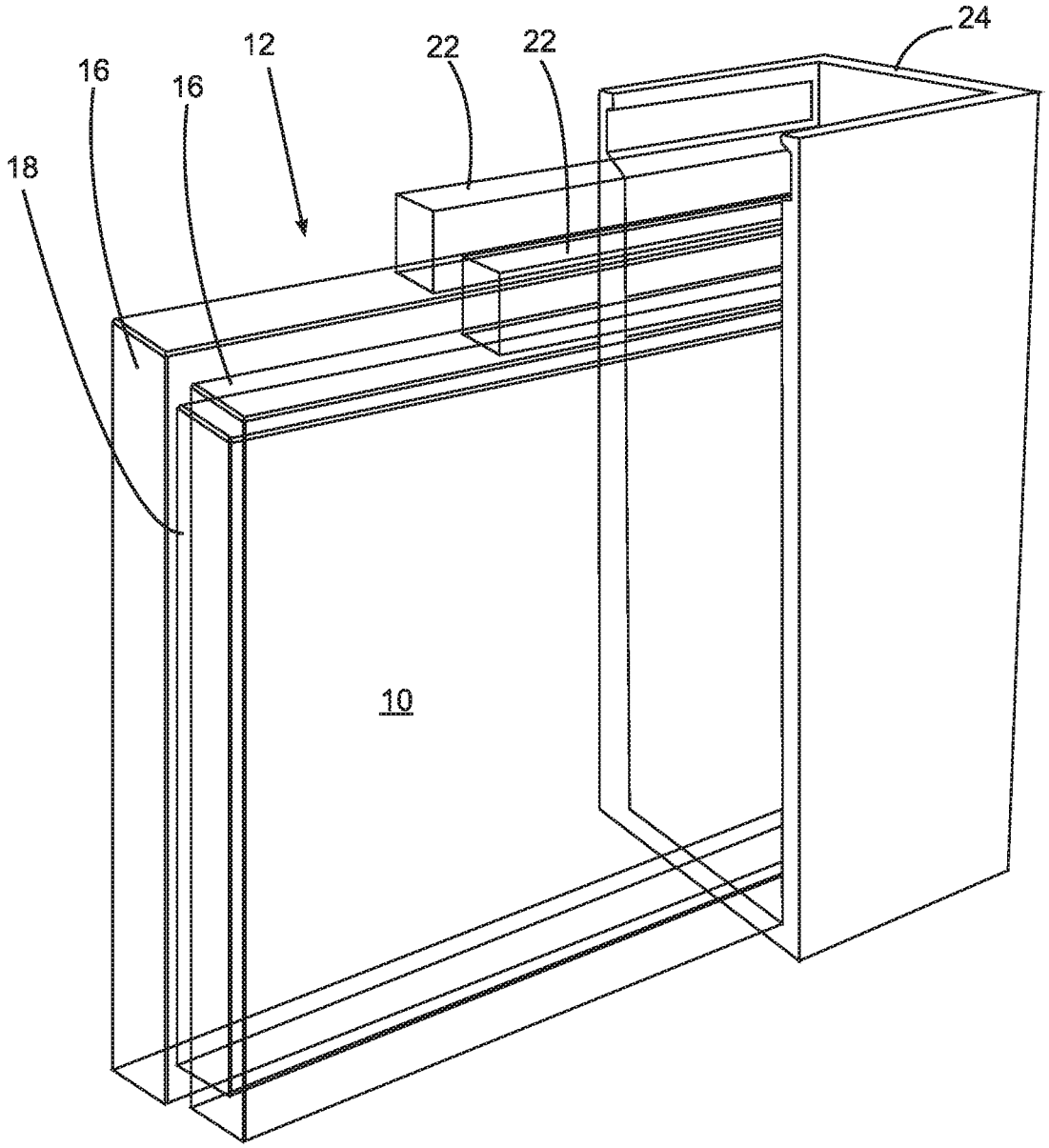
FIG. 3C is a broken-away, perspective view of the right end of the header of FIG. 1, showing the mounting bracket and an alternate embodiment of the shower door stops in which the stops are of the same length.

FIGS. 3A-3C and 8 show the use of roller stops 22 to stop the upper rollers 14 before the door 10 impacts against the side wall of the shower stall. In this embodiment, the roller stops 22 are ⅜ inch square profile acrylic pieces that are adhered to the top edges of the inner and outer glass rail pieces 16 of the header 12 using double sided tape. As noted below and as illustrated in FIG. 3B, the roller stops 22 fit under the cap 25 of each mounting bracket 24 and may be provided in different lengths depending upon how far it is desired to allow each door 10 to travel before being stopped.

Referring to FIGS. 3A and 3B, mounting brackets 24 are secured to the walls of the shower stall by any suitable means, such as screws (not shown). The mounting brackets 24 cradle and support the laminated header 12 and the roller stops 22. (The left mounting bracket 24 is a mirror image of the right mounting bracket 24.) When a flanged roller 14 reaches and abuts a roller stop 22, it cannot go any further, so the door 10 is stopped at that position.

As shown in FIG. 3B, there are lower securement screws 34 including support pads 35 projecting up from the bottom of each mounting bracket 24 to securely lock the header 12 in place between the bracket 24 and the bracket cap 25, as explained in more detail below.

A bracket cap 25 (See FIGS. 3A and 3B) slides into the parallel linear slots 32 (See FIGS. 3A and 3B) on each bracket 24. A set of top securement screws 34 (See also FIG. 8), in cooperation with the bottom securement screws 34 extending through the bottom surface of the bracket 24 (See FIG. 3B), are tightened to hold the header 12 and the roller stops 22 in place on the bracket 24.

Referring to FIGS. 1 and 2, a bottom guide bracket 26 may be used to guide the bottom edge of each door 10 to restrict the movement of the doors 10 to movement in line with the header 12.

As indicated earlier, the brackets 24 are secured to the walls of the shower stall at the desired height in order to support the laminated header 12. Care is taken to ensure that the brackets 24 are secured to the walls in a position that allows the header 12 to rest in a horizontal position and at the desired height such that the doors 10 reach down almost to the floor.

Installation:

The left and right mounting brackets 24 are secured to the walls at the left and right ends of the opening at the same elevation. The laminated header 12 and its corresponding roller stops 22 then are installed onto the left and right mounting brackets 24, with the header 12 resting on the pads 35 of the bottom screws 34 of each mounting bracket 24. The bottom screws 34 are then adjusted to ensure that the header 12 is level (i.e. horizontal). The bracket cap 25 is slid into place, and the top screws 34 are tightened to secure the header 12 and roller stops 22 in place. The upper flanged rollers 14 are installed on the doors 10. Each door 10 is then hung onto its respective rail 16 of the laminated header 12 via the upper flanged rollers 14 by simply lifting the door 10 until the upper flanged rollers 14 are above the laminated header 12 and then lowering the door 10 until the upper flanged rollers 14 of the door 10 are resting atop one of the rails 16 of the laminated header 12, as shown in FIGS. 7 and 7A, and the bottom edge of the door 10 is inside the bottom guide bracket 26. Lower pins 28 or rollers (See FIGS. 1, 2, 7, and 7A) are then installed and, if they are mounted eccentrically, they are adjusted to the proper elevation to ensure that the door 10 will not come off its rail 16 if accidentally bumped. (An eccentric cam type of lower pin 28 or roller is well known in the art to allow for the adjustment in elevation.)

Figure 9:
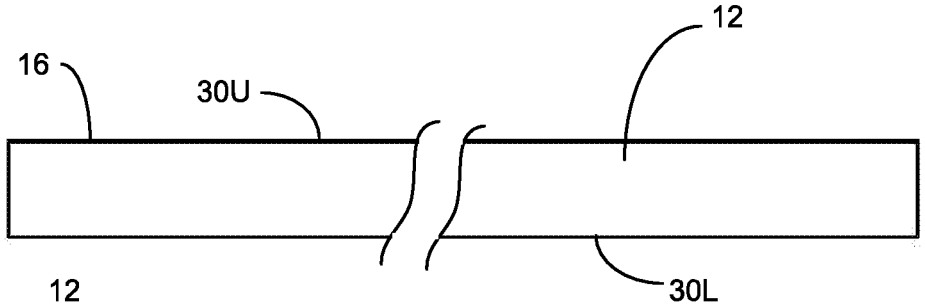
FIG. 9 is a front view of the header of FIGS. 1-6.

Referring now to FIG. 9, the header 12 is intended to be mounted in a horizontal orientation, so the top surfaces of the rails 16 are level. If the header 12 is mounted at a slight angle (not horizontal), so that one end of the header 12 is at a higher elevation than the other end, the glass doors 10 (See FIG. 1) will tend to move toward the lower elevation end of the header without any input from the user, just by virtue of the force of gravity acting on them. This means that care must be taken to install the mounting brackets 24 at substantially the same elevation.

Figure 10A:
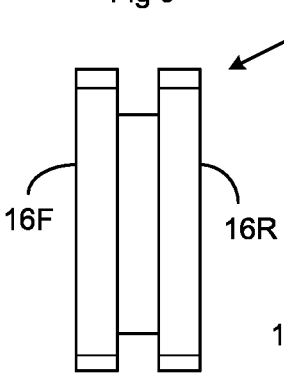
FIG. 10A is an end view of the header of FIG. 10.
Figure 10B:
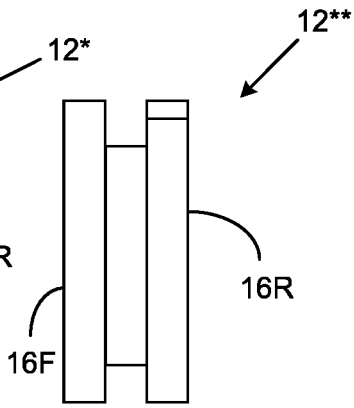
FIG. 10B is an end view of a header, similar to that of FIG. 10A, but with beveled ends only on the top portion of the rear rail of the header.
Figure 10:
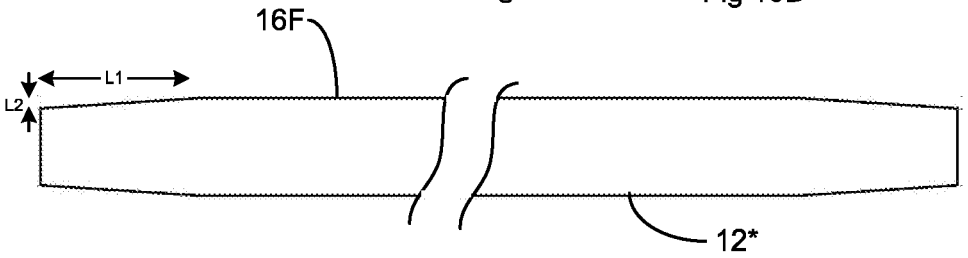
FIG. 10 is a front view, similar to that of the header of FIG. 9 but with beveled ends to provide an auto-closure feature for the shower doors.

Since it is impossible for an installer to mount the brackets 24 at exactly the same elevation, a modified header 12* has been developed as shown in FIG. 10, to help ensure that the doors 10 remain properly closed until someone moves them to the open position.

Figure 9A:
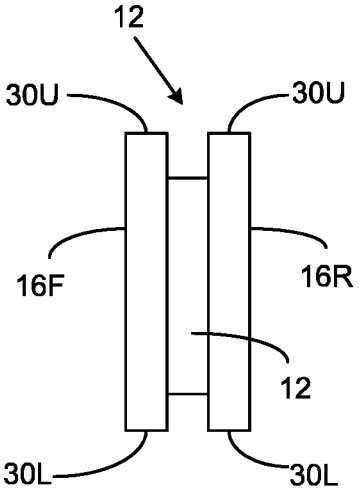
FIG. 9A is an end view of the header of FIG. 9.

The header 12 of the first embodiment and of FIGS. 9 and 9A has rails 16 with straight upper and lower edges 30U, 30 L respectively. The alternative header 12* of FIGS. 10 and 10A has upper and lower edges 30U*, 30L* that are straight in the middle portion but are tapered downwardly toward the ends. As best appreciated in FIG. 10A, both the front rail 16F, and the rear rail 16R have tapered ends.

In this header 12* of FIGS. 10 and 10A, the left and right ends of the top surfaces of the rails 16F and 16R taper down a distance "L2" over a distance "L1". In this particular embodiment, L2 is ⅛" and L1 is 10", but the exact dimensions could be somewhat different. The idea is that, when the door 10 approaches the fully open or fully closed position, the tapered end of the rail 16 causes the flanged roller 14 closest to the end of the header 12* to be at a lower elevation than the other flanged roller 14 on that door 10, which is at the higher elevation in the level, central portion of the rail 16. This enables the force or gravity to bias the door 10 toward the fully open or fully closed position and prevents the door 10 from unintentionally moving in the opposite direction, even if the header 12* is not mounted exactly horizontally. Another advantage of the tapered end(s) feature of the header 12* is that, if the door 10 is closed (or opened) to the point where one of its rollers 14 is resting on any portion of the tapered end, the slope of the tapered end acts to automatically and gently pull the door 10 the rest of the way to the fully closed (or fully open) position.

It should be noted in FIG. 10, that the bottom edges of the rails 16F, 16R are also tapered at the left and right ends, with the header 12* being symmetrical about a central horizontal axis, so if the header 12* is flipped over, with the bottom edge becoming the top edge, it will provide the same contour.

FIG. 10B shows another alternative embodiment of the header 12 wherein only one end of the upper edge of the rear rail 16R is tapered. It should be obvious that the header may have anywhere from no tapered ends (header 12 of FIGS. 9 and 9A), to all tapered ends (header 12* of FIGS. 10 and 10A), to having one or more tapered ends (header 12** of FIG. 10**B) depending on the requirements of the customer and of the installation.

While the embodiment described above has the doors 10 and the laminated header 12 made of completely clear glass, they may be made of completely translucent glass, glass that is clear but with some areas that are translucent, and other variations, if desired. Also, while the embodiment described above has two rails and one spacer, in order to support two doors, it may be desirable in some cases to have only a single rail with a single spacer laminated to the single rail by a structural interlayer, such as for a header which would support a single sliding door. It will be obvious to those skilled in the art that other modifications may be made to the embodiments described above without departing from the scope of the present invention as claimed.

What is claimed is:

1. A header for supporting a door, comprising:

a plurality of glass strips laminated together to form at least one rail having first and second ends; and left and right brackets which receive and support said first and second ends, respectively;

wherein said plurality of glass strips includes a first rail having a first rail top edge at a first elevation, a spacer, having a spacer top edge at a second elevation that is lower than said first elevation; and including a first structural interlayer laminating said first rail and spacer together.

2. A header for supporting a door as recited in claim 1, wherein said plurality of glass strips further includes a second rail having a second rail top edge at said first elevation, and further including a second structural interlayer laminating said second rail and said spacer together.

3. A header for supporting a door as recited in claim 2, wherein said header is symmetrical about a horizontal axis, with said header having a cross-sectional profile that is H-shaped.

4. A header for supporting a door as recited in claim 1, wherein said first rail has a first end, a second end, and a length from said first end to said second end, wherein said top edge is straight for most of said length, and defines a downward taper toward said first end.

5. A header for supporting a door as recited in claim 4, wherein said first rail top edge also defines a downward taper toward said second end.

6. A header for supporting a door as recited in claim 3, wherein said header has a first end, a second end, and a length from said first end to said second end, wherein said top edge of said first and second rails are straight for most of said length, with at least one of said rail top edges defining a downward taper toward said first end.

7. A header for supporting a door as recited in claim 6, wherein both of said first and second rail top edges define a downward taper toward both said first and second ends.

8. A header for supporting a door as recited in claim 7, wherein said header is symmetrical about a horizontal axis.

9. A header for supporting a door as recited in claim 1, and further comprising a glass door, having top and bottom sides, left and right sides, and inner and outer surfaces, a plurality of flanged rollers mounted on said glass door near said top side and straddling said first rail top edge to support and guide said glass door on said header.

10. A header for supporting a door as recited in claim 2, and further comprising first and second glass doors, each having top and bottom sides, left and right sides, and inner and outer surfaces, and a plurality of flanged rollers mounted on each of said glass doors near said respective top side, wherein the flanged rollers of said first glass door straddle said first rail top edge to support and guide said first glass door on said header, and the flanged rollers of said second glass door straddle said second rail top edge to support and guide said second glass door on said header.

* * * * *